US008713789B2

(12) United States Patent
Leidl et al.

(10) Patent No.: US 8,713,789 B2
(45) Date of Patent: May 6, 2014

(54) METHOD OF MANUFACTURING A MICROPHONE

(75) Inventors: Anton Leidl, Hohenbrunn (DE); Wolfgang Pahl, Munich (DE)

(73) Assignee: Epcos AG, Munich (DE)

( * ) Notice: Subject to any disclaimer, the term of this patent is extended or adjusted under 35 U.S.C. 154(b) by 321 days.

(21) Appl. No.: 13/094,515

(22) Filed: Apr. 26, 2011

(65) Prior Publication Data

US 2012/0275634 A1 Nov. 1, 2012

(51) Int. Cl.
*H04R 31/00* (2006.01)

(52) U.S. Cl.
USPC ..... 29/594; 29/417; 29/609.1; 257/414; 257/415; 310/330; 310/332; 310/340; 310/344; 310/345; 438/51; 438/114

(58) Field of Classification Search
USPC ..... 29/417, 592.1, 594, 595, 609.1, 831, 29/84; 257/414–420; 310/330–332, 340, 310/344, 345; 438/51, 114
See application file for complete search history.

(56) References Cited

U.S. PATENT DOCUMENTS

| | | | | |
|---|---|---|---|---|
| 4,830,623 | A * | 5/1989 | Owens et al. | 439/71 |
| 5,267,867 | A * | 12/1993 | Agahdel et al. | 439/73 |
| 5,414,917 | A * | 5/1995 | Tanaka | 29/25.35 |
| 6,617,673 | B2 * | 9/2003 | Lee et al. | 257/676 |
| 6,914,367 | B2 * | 7/2005 | Furukawa | 310/340 |
| 2009/0001553 | A1 | 1/2009 | Pahl et al. | |
| 2011/0039372 | A1 | 2/2011 | Loeppert et al. | |

FOREIGN PATENT DOCUMENTS

DE 102005053765 A1 5/2007

* cited by examiner

*Primary Examiner* — Paul D Kim
(74) *Attorney, Agent, or Firm* — Nixon Peabody LLP

(57) ABSTRACT

A method of manufacturing a microphone comprising a substrate, a transducer element that is mounted on a top side of the substrate, a covering layer that covers the transducer element and forms a seal with the top side of the substrate, a shaped covering material that covers the substrate, the transducer element and the covering layer, and a sound opening that extends through the covering material and the covering layer. Methods for manufacturing a microphone and for manufacturing a plurality of microphones are also disclosed.

17 Claims, 4 Drawing Sheets

METHOD OF MANUFACTURING A MICROPHONE

FIELD OF THE INVENTION

The present invention concerns a microphone and a method for manufacturing the microphone.

BACKGROUND OF THE INVENTION

In known MEMS microphones, a transducer element is flip-chip mounted on a substrate and covered by a covering layer. These microphones have excellent electro-acoustical properties and can effectively be minimized. However, these microphones show significant disadvantages regarding their handling, i.e. regarding assembly on a printed circuit board. In a typical assembly process, the MEMS device is handled by a vacuum nozzle. However, the surface of the element is very small and furthermore terraced. Therefore, the handling by the vacuum nozzle is difficult.

US 2011/0039372 A1 proposes a microphone package wherein a transducer element is covered by a cover comprising an aperture and a material is deposited around the cover. The material partly covers the side walls of the cover and thereby fixes the cover onto the substrate.

It is the object of the present invention to provide a microphone which has improved properties regarding its handling. Further, the present invention provides a method to manufacture the microphone.

BRIEF SUMMARY OF THE INVENTION

A microphone according to the present invention comprises a substrate, a transducer element that is mounted on the top side of the substrate, a covering layer that covers the transducer element and forms a seal with the top side of the substrate, a shaped covering material that covers the substrate, the transducer element and the covering layer, and a sound opening that extends through the covering material and the covering layer.

The shaped covering material which covers the substrate, the transducer element and the covering layer can be applied and shaped so that the microphone is shaped as a rectangular cuboid. This shape advantageously provides a flat surface which can be easily handled by a vacuum nozzle. Accordingly, in one embodiment the shaped covering material comprises a flat surface on the side that is facing away from the substrate.

In one embodiment the shaped covering material is further structured to form a sealing ring on the flat surface around the sound opening. If the microphone is integrated into a device, e.g. mobile phone, the sealing ring can form a sealed connection between the sound opening of the microphone and a sound opening in the cover of the mobile phone.

In one embodiment, the shaped covering material comprises a polymer. Particularly, the shaped covering material can comprise a thermosetting or a thermoplastic resin.

In one embodiment, the covering layer comprises a laminated foil and/or a metallization layer. The laminated foil forms a seal towards the substrate. The metallization layer protects the transducer element against electromagnetic interference (EMI).

In one embodiment, the microphone further comprises a second element that is also mounted on the top side of the substrate. The covering layer covers the transducer element and the second element and forms a seal with the top side of the substrate. Further, the shaped covering material too covers both the transducer element and the second element. The second element can be e.g. an application-specific integrated circuit (ASIC).

The present invention further provides a method to manufacture the microphone. This method comprises the steps of mounting a transducer element on a substrate, covering the transducer element with a covering layer forming a seal with the top side of the substrate, depositing a covering material on the substrate, the transducer element and the covering layer, shaping the covering material, and drilling a sound opening through the covering material and the covering layer.

In one embodiment, the covering material is deposited by applying a thermosetting resin or a thermoplastic resin or a elastomeric resin on the cover layer. Preferably, a liquid resin is applied and hardened in a next step, thereby shaping the covering material.

In one embodiment, the covering material is deposited and shaped by molding a resin onto the cover layer. Preferably, a mold is used in the molding process, the mold being adapted to form a cover with a flat surface on the side that is facing away from the substrate. Alternatively, the mold can be structured to form a sealing ring on the flat surface. In a next step a sound opening is drilled through the shaped covering material and the covering layer so that the sealing ring surrounds the sound opening.

The covering material can be deposited and shaped by injection molding.

In an alternative embodiment, a casting form is provided on the substrate, the casting form comprising a dam surrounding the transducer element. Further, the covering material is deposited and shaped by casting a liquid resin into the area surrounded by the dam and hardening the resin.

In one embodiment, the sound opening is drilled into the shaped covering material and the covering layer by a laser. Laser drilling allows a very precise positioning of the sound opening.

In one embodiment, the transducer element is flip-chip mounted on the substrate.

In one embodiment, the step of forming the covering layer comprises at least one of the steps of laminating a foil on the transducer element and on peripheral substrate and forming a metallization layer thereupon and galvanically enhancing the metallization layer. It is further possible to deposit a resin on selected areas of the metallization layer, so that these areas are not galvanically enhanced. After the step of galvanically enhancing, the resin can be removed. Preferably, the resin is applied at the location where the sound opening is drilled in a later step, so that the metallization layer is thinner here.

In one embodiment, a second element is mounted on the substrate. The second element can be an ASIC that is flip-chip mounted. Further, the method comprises the step of forming a cover layer that covers the transducer element and the second element and that forms the seal with the top side of the substrate.

The present invention further provides a method of manufacturing a plurality of microphones, the method comprising the steps of mounting a plurality of transducer elements on a substrate, wherein the plurality of transducer elements is positioned to create one or more channels bounded by two or more transducer elements, covering each transducer element with a covering layer forming a seal with the top side of the substrate at the bottom of the channels, depositing a covering material above the substrate, the transducer elements and the covering layers, shaping the covering material, drilling sound openings through the shaped covering material and the covering layer, wherein one or multiple sound openings correspond to one transducer element, and separating single microphones along the channels between the transducer elements. The covering material and the transducer element are separated by the covering layer which is in direct contact to the covering material. The covering material can be in direct contact to the substrate.

The steps of drilling the sound openings and separating the transducer elements are interchangeable. It is possible to first separate the microphones elements and then drill the sound openings or to first drill the sound openings and then separate the microphones.

The separation of the microphones can be done by mechanical sawing, laser cutting, or scribe and break.

BRIEF DESCRIPTION OF THE DRAWINGS

The present invention will be fully understood from the detailed description given herein below and the accompanying schematic drawings. In the drawings.

DETAILED DESCRIPTION OF THE INVENTION

FIGS. 1, 2, 3A and 4A show various steps of a manufacturing process of a microphone MIC.

Figure 1:
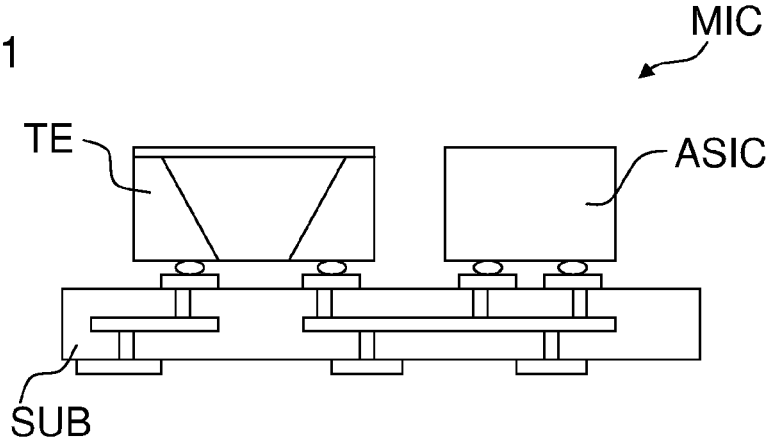
FIG. 1 shows a cross-sectional view of a microphone according to the present invention after a first step of the manufacturing process.

In a first manufacturing step, as shown in FIG. 1, a transducer element TE is flip-chip mounted on a substrate SUB. Further, an application specific integrated circuit ASIC is also flip-chip mounted on the substrate SUB.

The substrate SUB is a multi-layer substrate comprising metallization layers that are connected by through contacts, so-called vias. The transducer element and the ASIC are bonded on contact pads on top of the substrate or directly onto exposed vias.

Figure 2:
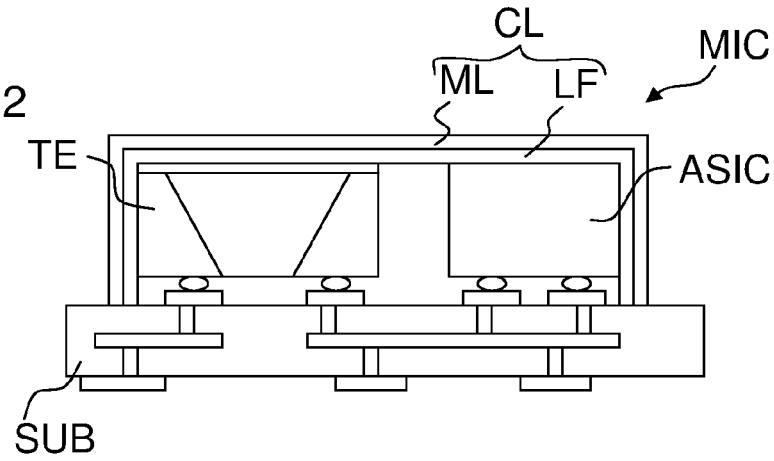
FIG. 2 shows a cross-sectional view of the microphone after a second step of the manufacturing process.

FIG. 2 shows the microphone MIC after a second manufacturing step. Here, a covering layer CL has been applied onto the transducer element TE and the ASIC. The covering layer CL can comprise multiple layers LF, ML. In this embodiment, the covering layer CL comprises a laminated foil LF which is laminated over the transducer element TE and the ASIC. The foil forms a seal with the top side of the substrate SUB.

Further, the covering layer CL comprises one or multiple metallization layers ML. The metallization layer ML is galvanically enhanced. Further, it is possible to position a resin at the position for the sound opening. Thereby, the metallization layer ML is not enhanced at this place. Accordingly, a thinner metallization layer ML is formed at the place where the sound opening will be placed in a later process step. This simplifies the later drilling of the sound opening.

The metallization layer ML protects the transducer element and the ASIC against electromagnetic interference.

Figure 3A:
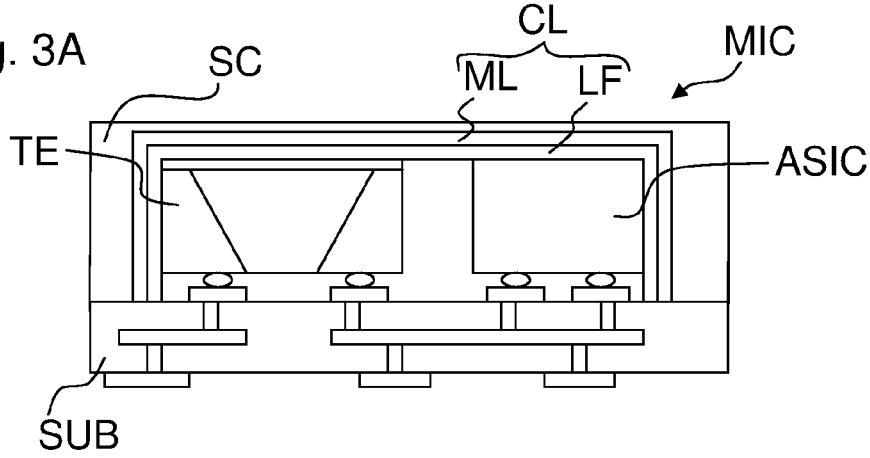
FIG. 3A shows a cross-sectional view of the microphone after a third step of the manufacturing process.

FIG. 3*a* shows the microphone MIC after a third manufacturing step. In the third manufacturing step, a covering material is deposited and forms a shaped covering SC on the substrate SUB and the covering layer CL. The shaped covering SC completely covers the top side of the covering layer CL which is facing away from the substrate SUB.

The shaped covering SC comprises polymer. The covering material is applied and formed into a shaped covering by a molding process, preferably by injection molding, transfer molding or compression molding. Thereby, a liquid resin is applied in a closed mold. The mold is shaped to form a cuboid-shaped microphone MIC. The cuboid shape provides a flat surface on the top side of the microphone MIC, allowing an easier handling during a manufacturing process of the microphone MIC on a printed circuit board, e.g. for use in a mobile phone, and further providing an improved acoustical sealing of the sound opening towards an opening in this device.

Figure 4A:
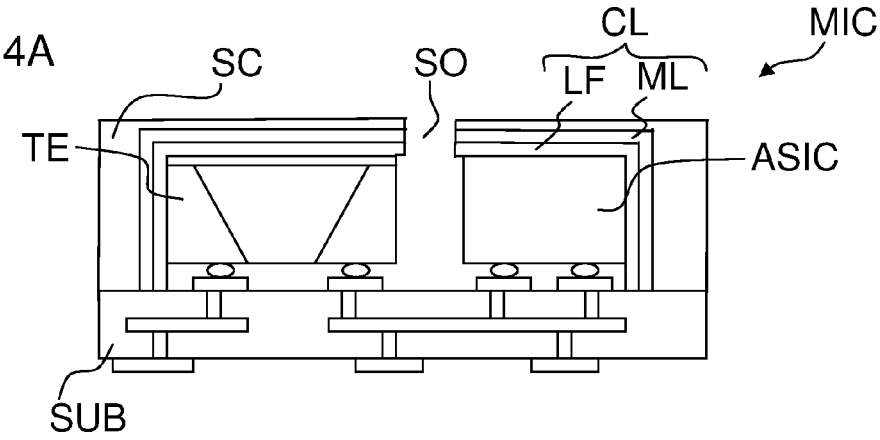
FIG. 4A shows a cross-sectional view of the microphone after the manufacturing process is completed.

In a next step, a sound opening SO is drilled through the shaped covering SC and the covering layer CL. FIG. 4*a* shows the microphone MIC after completion of this manufacturing step. If an acoustic signal provides a pressure variation at the microphone MIC, the acoustic signal can propagate through the sound opening SO and the pressure is applied on the transducer element TE.

Figure 3B:
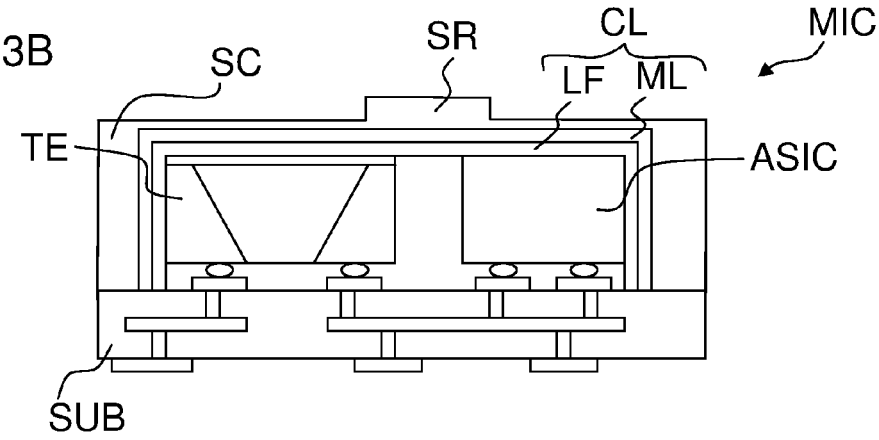
FIG. 3B shows a cross-sectional view of the microphone after a third step of in an alternative manufacturing process.

FIG. 3*b* shows the microphone MIC after an alternative third manufacturing step. Here, the closed mold which is used for molding the shaped covering SC is structured to form a sealing ring SR on the otherwise flat surface of the shaped covering SC. The sealing ring can comprise a central opening. Alternatively, this opening can be formed at the step of drilling the sound opening.

Figure 4B:
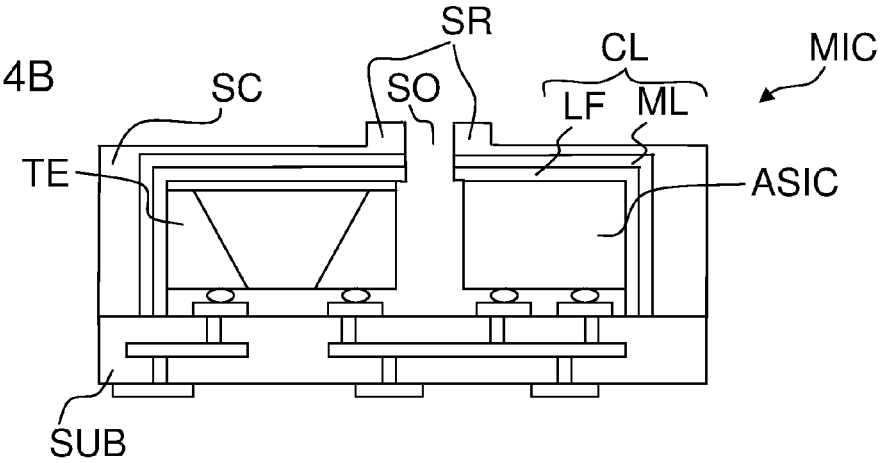
FIG. 4B shows a cross-sectional view of the microphone after the alternative manufacturing process is completed.

FIG. 4*b* shows the microphone after completion of the alternative manufacturing process. The sound opening SO is drilled and guided through the shaped covering SC and the covering layer CL. The sound opening SO is positioned so that the sealing ring SR surrounds the sound opening SO. The sealing ring SR provides an interface with a sound opening of a mobile phone when the microphone MIC is integrated into a mobile phone. Hence, the sealing ring allows sealing the sound opening of the microphone MIC to the sound opening of a mobile phone.

Furthermore, a material can be used as shaped covering SC that is elastic with a module of elasticity which is smaller than 100 MPa (megapascals). In this case, the sealing function of the sealing ring SR connecting the sound opening SO to a sound opening in a phone cover is further improved.

Figure 5:
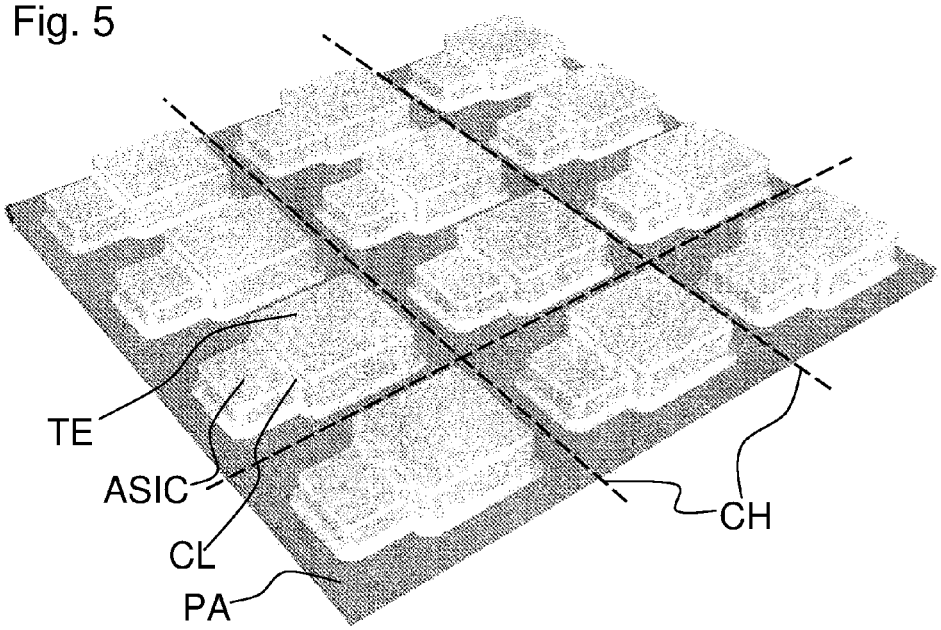
FIG. 5 shows a perspective view of a panel comprising multiple microphones during the second step of the manufacturing process.

FIG. 5 shows a panel PA forming a common substrate for a plurality of microphones. Multiple transducer elements TE and ASICs are mounted on the panel PA. Each ASIC is placed next to a transducer element TE, thereby forming a pair comprising one transducer element TE and one ASIC. Each pair is covered by a covering layer CL. The covering layer CL can comprise a laminated foil and a metallization layer.

The pairs of transducer element TE and ASIC are positioned in regular rows and columns such that channels CH between the transducer elements TE are formed.

In this embodiment, the covering layer CL is structured in a next step. The laminated foil is removed in the channels CH between the transducer elements TE. Thereby, the metallization layer is in direct contact to the substrate SUB, forming a sealing. Alternatively, the covering layer and the metallization layer too can be removed in the channels CH, so that the covering material which forms the shaped covering SC can be deposited directly on the substrate SUB in a later step.

In a next process step, the covering material is applied onto the pairs of transducer elements TE and ASICs and onto the panel PA. The covering material can be applied and formed into a shaped covering SC to completely cover the transducer elements TE, the ASICs, the covering layers CL and the panel PA.

Figure 6:
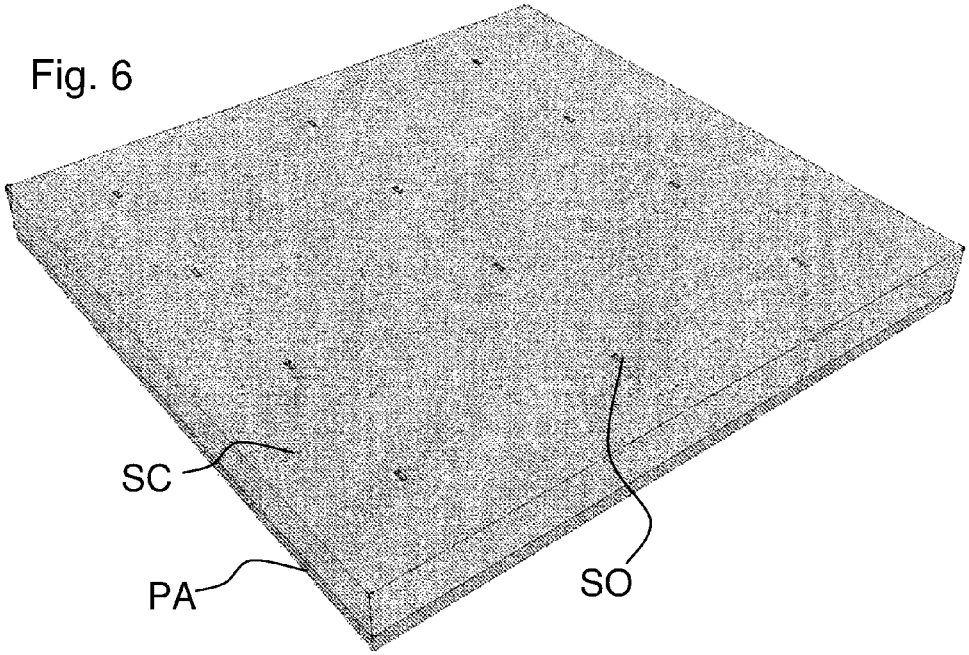
FIG. 6 shows the panel of FIG. 5 after a covering material has been deposited and sound openings have been drilled.
Figure 7:
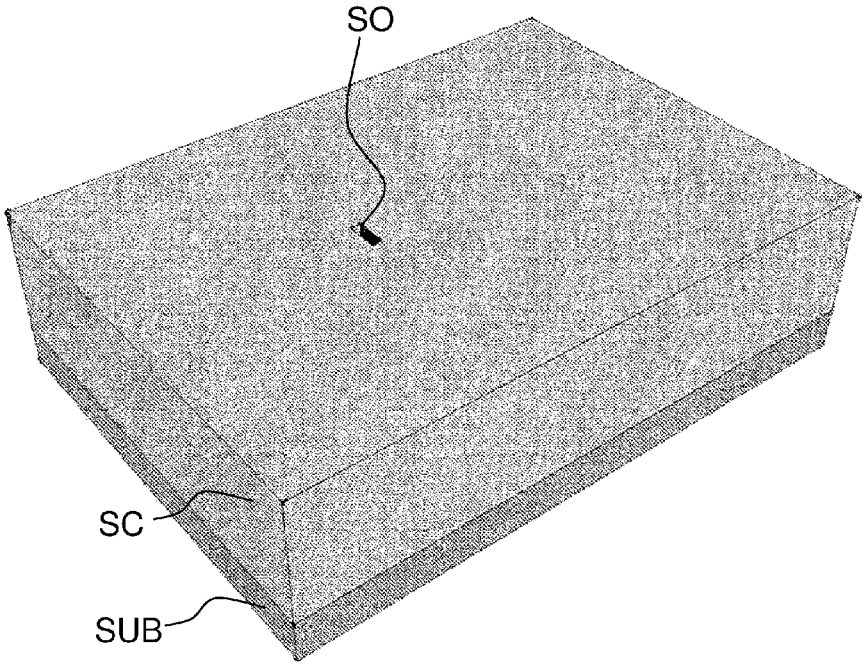
FIG. 7 shows a perspective view of the microphone according to the present invention after the manufacturing process has been completed and the common substrate has been cut into individual components.

The shaped covering SC is applied and formed using a closed molding form that is shaped as a rectangular cuboid. Accordingly, the assembly comprising the panel PA, the transducer elements TE, the ASICs, the covering layers CL and the shaped covering SC is now shaped as a rectangular cuboid. In a next process step, sound openings SO are drilled through the shaped covering SC, e.g. by a laser. The sound openings SO correspond to transducer elements TE. FIG. 6 shows the assembly after this process step.

In a next process step the panel PA and the shaped covering SC is cut into singular chips each forming a microphone. Each chip comprises one pair of a transducer element TE and an ASIC covered by a covering layer CL and a shaped covering SC. Each chip is shaped as a rectangular cuboid. The cutting is done along the channels CH which have been defined between the pairs comprising a transducer element TE and an ASIC respectively.

In the sequence of the process steps, the steps of separation of the microphone MIC and of drilling the sound openings SO are interchangeable.

In an alternative manufacturing method, instead of a closed mold for injection molding, only a wall is formed around the panel PA. The resin is applied as a liquid by casting the resin onto the area inside this wall such that the resin covers the covering layer CL completely. In a next step, the resin is hardened. However, injection molding is the preferred manufacturing method as this method allows a more precise manufacturing of the shaped covering SC.

What is claimed is:

1. A method of manufacturing a microphone, comprising:
mounting a transducer element on a substrate;
covering the transducer element with a covering layer forming a seal with a top side of the substrate;
depositing a covering material above the substrate, the transducer element and the covering layer;
shaping the covering material into a cuboid-shaped covering, and
drilling a sound opening through the shaped covering and the covering layer, wherein the shaped covering is formed by molding a resin onto the covering layer, wherein
a mold is used in the molding, the mold being adapted to form (a) a cover with a flat surface on a side that is facing away from the substrate or (b) a sealing ring on the flat surface, and wherein
the sound opening is drilled through the shaped covering and the covering layer so that the sealing ring surrounds the sound opening.

2. The method according to claim 1, wherein the depositing the covering material or the shaping the shaped covering includes applying a thermosetting resin or a thermoplastic resin or an elastomeric resin onto the covering layer.

3. The method according to claim 1, wherein the depositing the covering material or the shaping the shaped covering includes applying a liquid resin and hardening the liquid resin.

4. The method according to claim 1, wherein the covering material is deposited and shaped into the shaped covering by injection molding, transfer molding, or compression molding.

5. The method according to claim 1, further comprising:
providing a casting form on the substrate, the casting form including a dam surrounding the transducer element;
the depositing and the shaping the covering material including casting a liquid resin onto the area surrounded by the dam; and
hardening the covering material.

6. The method according to claim 1, wherein the drilling the sound opening is carried out by a laser.

7. The method according to claim 1, wherein the transducer element is flip-chip mounted on the substrate.

8. The method according to claim 1, wherein the forming the covering layer includes:
laminating a foil on the transducer element; or
forming a metallization layer on the transducer element and galvanically enhancing the metallization layer.

9. The method according to claim 1, further comprising:
mounting a second element on the substrate; and
forming the covering layer that covers the transducer element and the second element and that forms a seal with the top side of the substrate.

10. A method of manufacturing a microphone, comprising:
mounting a transducer element on a substrate;
covering the transducer element with a covering layer forming a seal with a top side of the substrate;
depositing a covering material above the substrate, the transducer element and the covering layer;
shaping the covering material into a shaped covering such that the shaped covering forms a sealing ring on a side that is facing away from the substrate and such that the shaped covering forms a surface on the side that is facing away from the substrate wherein the surface is flat apart from the sealing ring; and
drilling a sound opening through the shaped covering and the covering layer so that the sealing ring surrounds the sound opening.

11. The method according to claim 10, wherein the depositing the covering material or the shaping the shaped covering includes applying a thermosetting resin or a thermoplastic resin or an elastomeric resin onto the covering layer.

12. The method according to claim 10, wherein the depositing the covering material or the shaping the shaped covering includes applying a liquid resin and hardening the liquid resin.

13. The method according to claim 10, wherein the shaped covering is formed by molding a resin onto the cover layer.

14. The method according to claim 13, wherein a mold is used in the molding, the mold being adapted to form a cover with a flat surface on a side that is facing away from the substrate.

15. The method according to claim 10, wherein the covering material is deposited and shaped into a shaped covering by injection molding, transfer molding, or compression molding.

16. The method according to claim 10, further comprising:
providing a casting form on the substrate, the casting form including a dam surrounding the transducer element;
casting a liquid resin onto the area surrounded by the dam to shape the shaped covering; and
hardening the covering material.

17. A method of manufacturing a microphone, comprising:
mounting a transducer element on a substrate;

covering the transducer element with a covering layer forming a seal with a top side of the substrate;

depositing a covering material above the substrate, the transducer element and the covering layer;

shaping the covering material into a cuboid-shaped covering;

drilling a sound opening through the shaped covering and the covering layer;

providing a casting form on the substrate, the casting form including a dam surrounding the transducer element;

casting a liquid resin onto the area surrounded by the dam to form the shaped covering; and hardening the covering material.

* * * * *